United States Patent [19]

Cooksley

[11] 3,968,346

[45] July 6, 1976

[54] METHOD AND APPARATUS FOR ELECTRICALLY HEATING A FLUID

[76] Inventor: Ralph D. Cooksley, Great Meadow Towers, 1800 Silas Deane Highway, Rocky Hill, Conn. 06067

[22] Filed: June 1, 1973

[21] Appl. No.: 366,050

[52] U.S. Cl. ..... 219/305; 122/31 R; 165/1; 165/155; 219/301; 219/306; 219/314; 219/341

[51] Int. Cl.[2] ..... H05B 1/00; F24H 1/12

[58] Field of Search ..... 219/296–309, 219/318, 314, 315, 310, 312; 165/154–156, 1; 222/146 H, 146 HE; 122/31 R; 237/58, 72

[56] References Cited

UNITED STATES PATENTS

| | | | |
|---|---|---|---|
| 223,911 | 1/1880 | Hinsdale | 237/58 |
| 1,045,975 | 12/1912 | Haskell | 219/299 |
| 1,494,326 | 5/1924 | Adams | 219/299 X |
| 1,534,298 | 4/1925 | Clark | 219/299 |
| 1,670,506 | 5/1928 | Johnson | 219/306 |
| 1,772,557 | 8/1930 | Schumers | 219/299 |
| 1,797,520 | 3/1931 | Case | 219/299 |
| 1,977,156 | 10/1934 | Staley | 219/306 |
| 1,994,765 | 3/1935 | Harvey | 219/306 X |
| 2,026,809 | 1/1936 | Wimm | 219/306 X |
| 2,462,746 | 2/1949 | Inman | 219/306 X |
| 2,822,157 | 2/1958 | Porter | 122/31 X |
| 3,247,359 | 4/1966 | Feld | 219/306 X |

FOREIGN PATENTS OR APPLICATIONS

| | | | |
|---|---|---|---|
| 130,812 | 1/1949 | Australia | 122/31 |
| 325,316 | 9/1920 | Germany | 219/319 |

*Primary Examiner*—A. Bartis

[57] ABSTRACT

A compact and fast acting tankless heater has an elongated tubular casing having water inlet and outlet conduits at opposite ends. A elongated generally helically twisted inner tube is disposed coaxially within the casing to define helical channel means between the tube and casing for conducting water longitudinally from the casing inlet to the casing outlet. The inner tube has a water inlet at one end communicating with the water inlet of the casing and the other end of the tube is closed. An elongated electric heating means is disposed within the inner tube for heating the water therein. The inner tube has a plurality of longitudinally spaced openings for conducting hot water and steam from the inner tube into the helical channel means to combine with the water flowing through the helical channel means from the casing inlet to the casing outlet. An additional electric heater sleeve can be provided to surround the exterior of the casing.

10 Claims, 8 Drawing Figures

TO ELECTRIC POWER SUPPLY
TO ELECTRIC POWER SUPPLY
HOT WATER AND STEAM
SILICONE RUBBER REINFORCED WITH FIBERGLASS
FROM COLD WATER SUPPLY
THERMAL INSULATION
HW
W
10
2
2
C

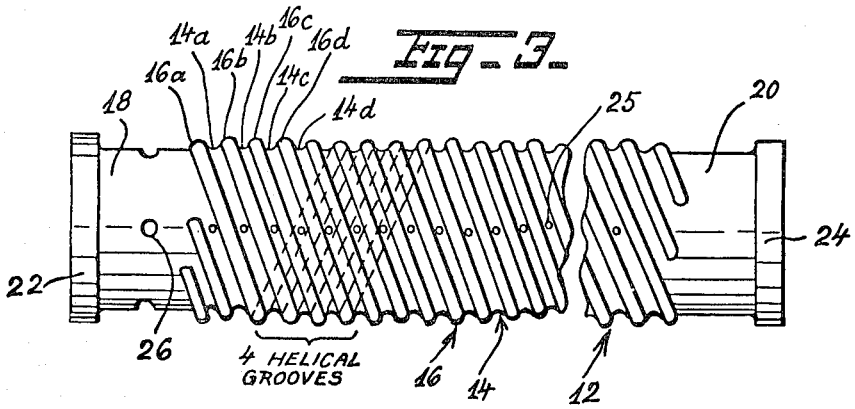
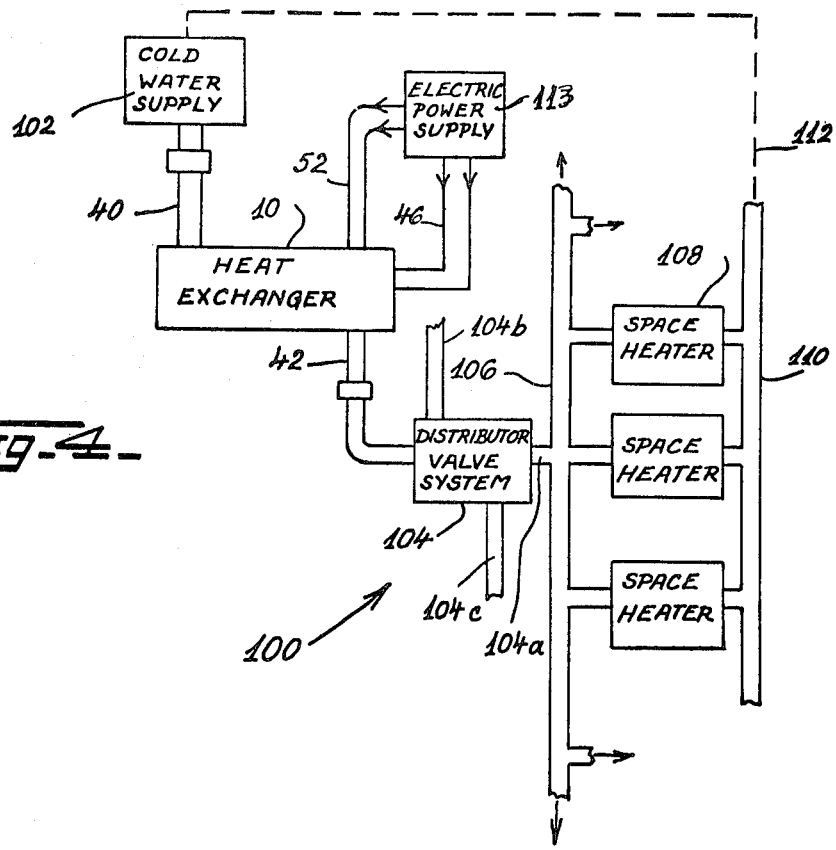
FIG. 4

10A
42a
40a
62
30a
45a
12a
52
60
66
6
44
25
16
50
46a
55a
34b
65
64
62'
LAY SW.
LAY SW.
30b
30a
46a
55
46'

METHOD AND APPARATUS FOR ELECTRICALLY HEATING A FLUID

BRIEF SUMMARY OF THE INVENTION

The present invention relates generally to heat exchangers and more particularly to a new and improved fast acting heat exchanger having notable utility in a compact form thereof as a tankless domestic water heater.

It is a principal aim of the present invention to provide a new and improved electrically powered heat exchanger useful as a tankless water heater for providing hot water for domestic consumption and/or heating. In accordance with the present invention, the heat exchanger may be compactly made to provide hot water on a continuous or intermittent basis as necessary to meet the domestic hot water requirements.

It is another aim of the present invention to provide a new and improved heat exchanger which provides for heating water practically instantaneously.

It is another aim of the present invention to provide a new and improved heat exchanger having high thermal efficiency and thermal conductivity.

It is a further aim of the present invention to provide a new and improved heat exchanger for heating a moving fluid and providing exceptional heat transfer between the heat source and the moving fluid.

It is another aim of the present invention to provide a new and improved electric water heater having a highly concentrated electrical heat source and providing for heating the water to a transient vapor state to substantially increase the heat exchange rate.

It is another aim of the present invention to provide a new and improved heat exchanger which can be compactly constructed and which provide long and reliable service free operation.

It is a further aim of the present invention to provide a new and improved electric heat exchanger providing a compact and economical water heater for domestic use.

Other objects will be in part obvious and in part pointed out more in detail hereinafter.

A better understanding of the invention will be obtained from the following detailed description and the accompanying drawings of illustrative applications of the invention.

BRIEF DESCRIPTION OF THE DRAWINGS

In the drawings:

FIG. 3 is an enlarged longitudinal side view, partly broken away, of a twisted tube of the heat exchanger;

FIG. 4 is a partial diagram of a space heating system employing the heat exchanger;

DESCRIPTION OF THE PREFERRED EMBODIMENTS

Figures 1, 2:
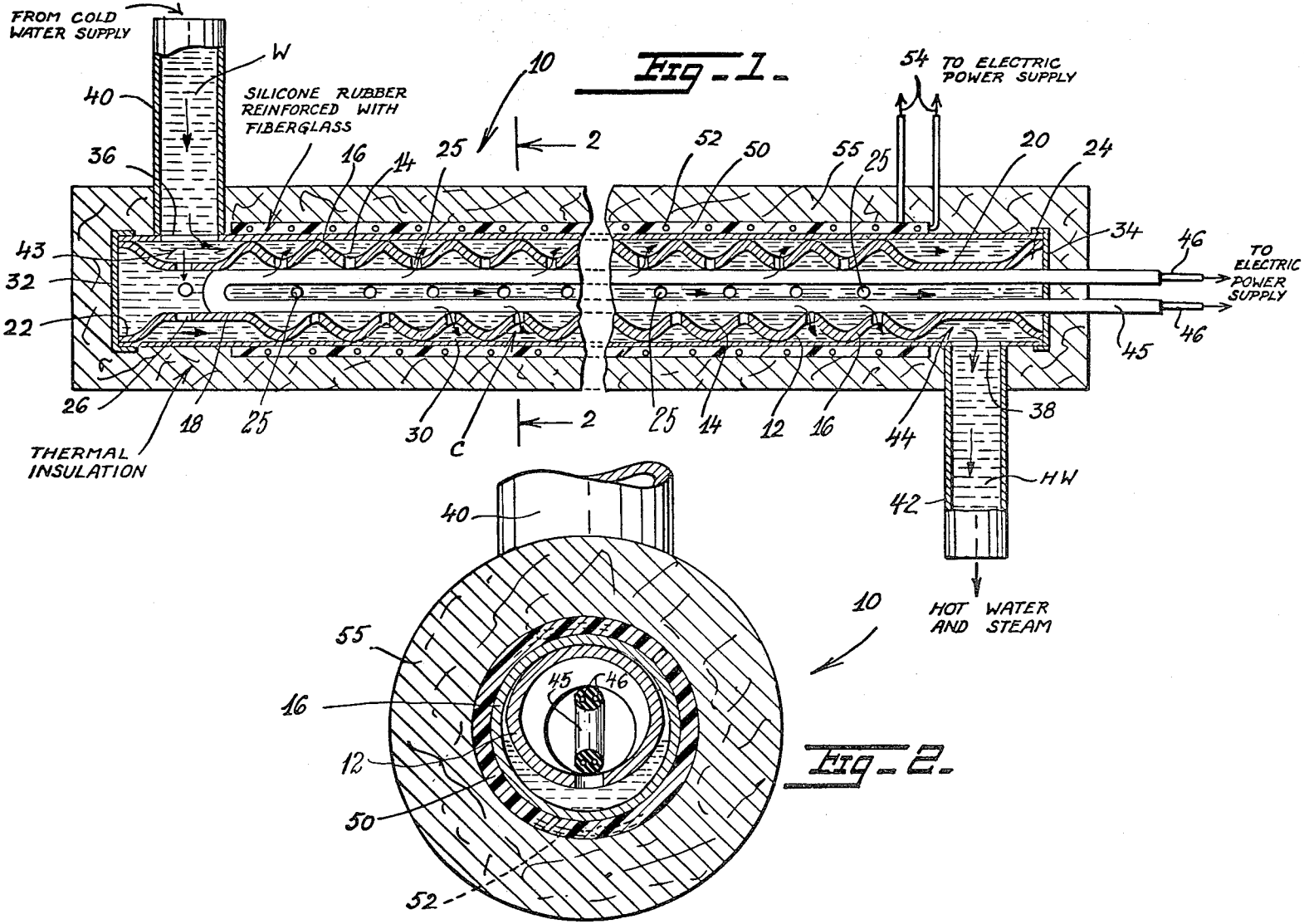
FIG. 1 is a longitudinal section view, partly broken away and partly in section, of an embodiment of a heat exchanger incorporating the present invention.
FIG. 2 is an enlarged transverse section view, partly broken away and partly in section, taken substantially along line 2—2 of FIG. 1.

Referring now to the drawings in detail wherein like numerals represent like parts, and referring in particular to an embodiment 10 of a heat exchanger of the present invention shown in FIGS. 1–3, the heat exchanger 10 is shown comprising an elongated generally cylindrical inner twisted tube 12 having a plurality of generally helical corrugations providing alternating helical grooves 14 and ridges 16. As best shown in FIG. 3, there are four separate and parallel corrugations providing four separate and parallel grooves 14*a*, 14*b*, 14*c*, 14*d* and four alternating separate and parallel ridges 16*a*, 16*b*, 6*c*, 16*d* which run parallel to each other for nearly the entire length of the tube 12. Tubes of this type can be made by methods such as described in U.S. Pats., Reissue No. 24,783 (of Robert P. Humphrey, dated Feb. 16, 1960, and entitled "Apparatus and Method for Making Spirally Corrugated Metal Tubes"), and U.S. Pat. No. 3,015,355 (of Alfred H. Humphrey, dated Jan. 2, 1962, and entitled "Method For Forming Spirally Ribbed Tubing"). The tube 12 has cylindrical end portions 18, 20 of reduced diameter ans enlarged cylindrical end flanges 22, 24. In each turn of each of the grooves 14 is one or more apertures or openings 25. Additional larger apertures or openings 26 are provided in the cylindrical end 18. The twisted metal tube 12 has a substantially uniform outer diameter and a substantially uniform wall thickness from end to end thereof and provides a large heating surface in a small compact heat exchanger.

The twisted or spirally corrugated metal tube 12 is disposed inside a tubular metal jacket or casing 30 in a tight fitting manner with the ridges 16 contacting the inner cylindrical wall surface of the casing 30 to provide four helical flow channels indicated at C around the tube 12. Flanges 22, 24 tightly fit within the ends of the tubular casing 30, and closure caps 32, 34 are applied to the ends of the casing. The jacket or casing 30 has lateral openings 36, 38 at its opposite ends to which are connected inlet and outlet conduits 40, 42. The radially extending conduits 40, 42 serve respectively as a fluid inlet and fluid outlet for the heat exchanger. The reduced cylindrical portions 18 and 20 of the tube 12 have a smaller diameter than the inside of the casing 30 to define two annular chambers 43, 44 at opposite ends of the casings adjacent the inlet and outlet conduits 40, 42 respectively.

Inside the twisted or spirally corrugated tube 12 is a looped electrical heating rod 45 enclosing an insulated heater wire 46 in a water tight manner. The ends of the rod extend out through the cap at the outlet end of the casing. The end of wires 46 are suitably connected to an external electric power supply to provide for energizing the electrical heating rod 45. The rod 45 is almost as long as the tube 12 and is supported by the inner sides of the grooves 14 and the reduced cylindrical end portions 18, 20. The shown heating rod 45 may be of the type known in the trade as a "Calrod" heating rod, and which does not oxidize at an elevated temperature.

Surrounding the metal casing 30 is an electric heating sleeve 50 which may be a rubberized flexible heating mat as shown. This sleeve 50 may be composed of silicone rubber reinforced with fiberglass and having a resistance heater wire or coil 52 embedded therein. The wire 52 terminates in external terminals 54 which can be connected to a suitable external electric power supply. Surrounding the casing 30 and sleeve 50 is a thick body 55 of thermal insulation material such as asbestos, rock wool, fiberglass or the like.

Using the heat exchanger as a water heater, the water to be heated is fed into the device through inlet conduit 40. This water enters annular chambers 43. Communicating with chamber 43 is the interior of the twisted tube 12. Also, communicating with chamber 43 are the parallel helical channels C defined by the grooves 14, ridges 16, and the inner surface of the casing 30. The inlet water thus enters both the tube 12 and the four parallel channels C of flow. The water in tube 12 is quickly heated by the heater rod 45 and turned to steam which passes through the lateral apertures 25 and mixes with the water in the channels C to heat this water. The water is driven through and around the twisted tube 12 and channels C under the pressure of the incoming water supply. Hot Water HW containing steam and/or superheated water flows through chamber 44 and out the outlet conduit 42. The twisted tube 12 has no direct outlet and the water and steam in this twisted tube must pass through openings 25 into the parallel channels C to reach the outlet conduit 42. The conversion of water to steam within the tube 12 (and the concomitant large transfer of heat in vaporizing the water) and reconversion of the steam to water in the outer channels C permits using a high watt density heat source and provides a highly concentrated and rapid form of heat transfer from the heater rod 45 to the water flowing through the outer tube.

Electrically heated sleeve 50 serves to raise the temperature of casing 30 and to thereby provide additional means (which may be selectively used when desired) for heating the water passing through the channels C. Thermal insulation 55 maintains the thermal effficiency of the device by inhibiting heat loss from the sleeve 50 as well as around the ends of conduits 40, 42 and around casing 30 and end caps 32 and 34.

FIG. 4 shows a space heating system 100 employing the heat exchanger 10. A cold water supply 102 is connected to the heat exchanger inlet conduit 40, and the outlet conduit 42 is connected to a distributor valve system 104 having outlets 104*a*, 104*b* and 10497 *c*. Connected to this valve system through outlet 104*a* is a manifold pipe arrangement 106 which feeds hot water to space heaters 108. The space heaters 108 are connected to an outlet pipe 110 which may be suitably connected to discharge the used water, or preferably, the outlet pipe 110 is connected to the cold water supply 102 as indicated by broken line 112 to provide for recirculating the water. Both electric heating wires 46 and 52 may be connected to the same electric power supply 113.

The heat exchangers 10 may be interposed in other systems where a quick acting and practically instantaneous tankless heat exchanger of the character described may be usefully employed to replace prior known boilers heated by combustion of oil, gas, or fossil fuels. Instead of four parallel helical grooves 14 and ridges 16, more or fewer than four helical grooves and ridges may of course be provided. The twisted tube 12 should preferably be made of copper or other metal having high thermal conductivity. Casing 30 may be similarly constructed, or if desired, the casing 30 can be replaced by a jacket made of ceramic, tempered glass or other suitable insulating material.

The apertures 25 in the grooves 14 of the twisted tube 12 allow the heating unit to be flooded with water at the same time that the flow of water is passing helically around the outside of the twisted tube 12. It will be understood that water is premitted to flow into the inner twisted tube 12 but no provision is made to let water flow out except through the apertures 25 and therefore primarily in the form of steam generated within the tube 12 by the heater rod 45. In effect, there has been provided a small steam generator which will eject steam into the helically moving water surrounding the tube 12 to heat that moving water stream.

Water has generally poor heat transfer, and by breaking the flow into four channels the speed of the heating process is substantially increased. While water has been mentioned, it should be understood that other fluids may be heated with the same benefits and other forms of heaters may also be used in lieu of the electrical heater rod 45.

Figures 5, 6, 8:
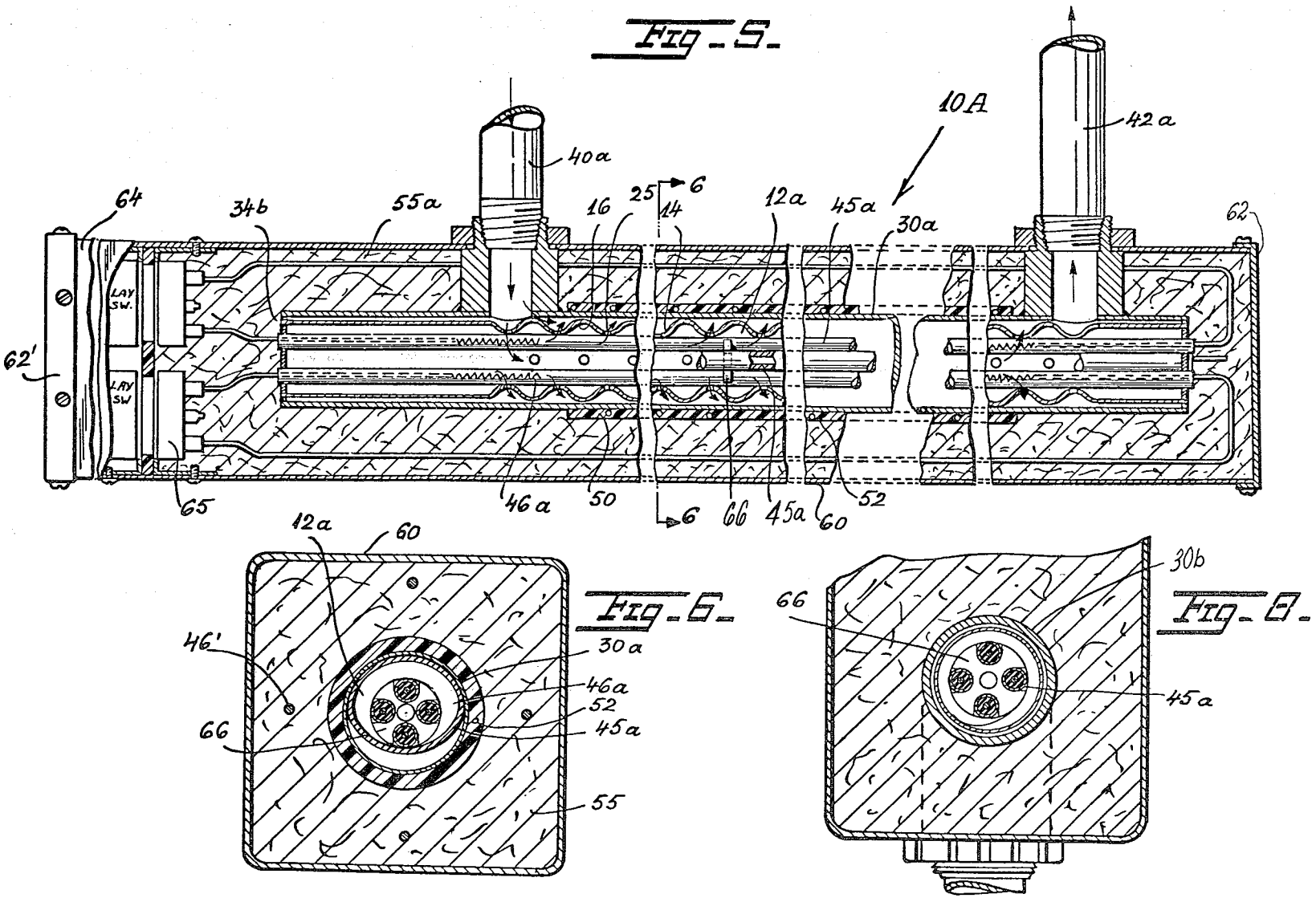
FIG. 5 is a longitudinal section view, partly broken away and partly in section, of another embodiment of a heat exchanger incorporating the present invention.
FIG. 6 is an enlarged cross section view, partly in section, taken substantially along line 6—6 of FIG. 5.
FIG. 8 is a partial cross section view, partly broken away and partly in section, taken substantially along line 8—8 of FIG. 7.

In FIGS. 5 and 6 there is shown another embodiment 10A of a heat exchanger incorporating the present invention which is basically the same as the heat exchanger 10, with corresponding parts identically numbered. In heat exchanger 10A, four straight electrical heating elements or rods 45*a* are provided and held in a fixed annular array by suitable spaced support members 66 disposed inside the twisted tube 12*a*. The tube 12*a* is located in casing 30*a* which is wholly enclosed in thermal insulation body 55*a*. The heating elements 45*a* extend outwardly of end walls 34*a*, 34*b* of the casing 30 at opposite ends of the casing 30*a* and tube 12*a*. Inside each rod is a resistance wire 46*a*. Opposite ends of the resistance wires extend through the insulation body 55*a* and terminate at relay switches 65 located in relay box 64 at the end of the assembly and connected in a suitable thermostatically controlled circuit. The heat exchanger 10A has an outer rectangular metal cover or casing 60 which encloses the insulation body 55*a* and is closed at its right end as viewed in FIG. 5 by cap 62. Cap 62' at the other end of the assembly closes the relay box 64. The heat exchanger has an inlet conduit 40*a* and an outlet conduit 42*a* extending radially of the assembly at opposite ends of tube 12 *a*. The heat exchanger 10A basically operates in the same manner as described above for heat exchanger 10 so the description of its operation need not be repeated. The relay switches 65 serve to turn on and off the electric heater wires 46*a*, and the heater coil or wire 52 in heater mat 50 is energized in the same manner as described in connection with heat exchanger 10.

Figure 7:
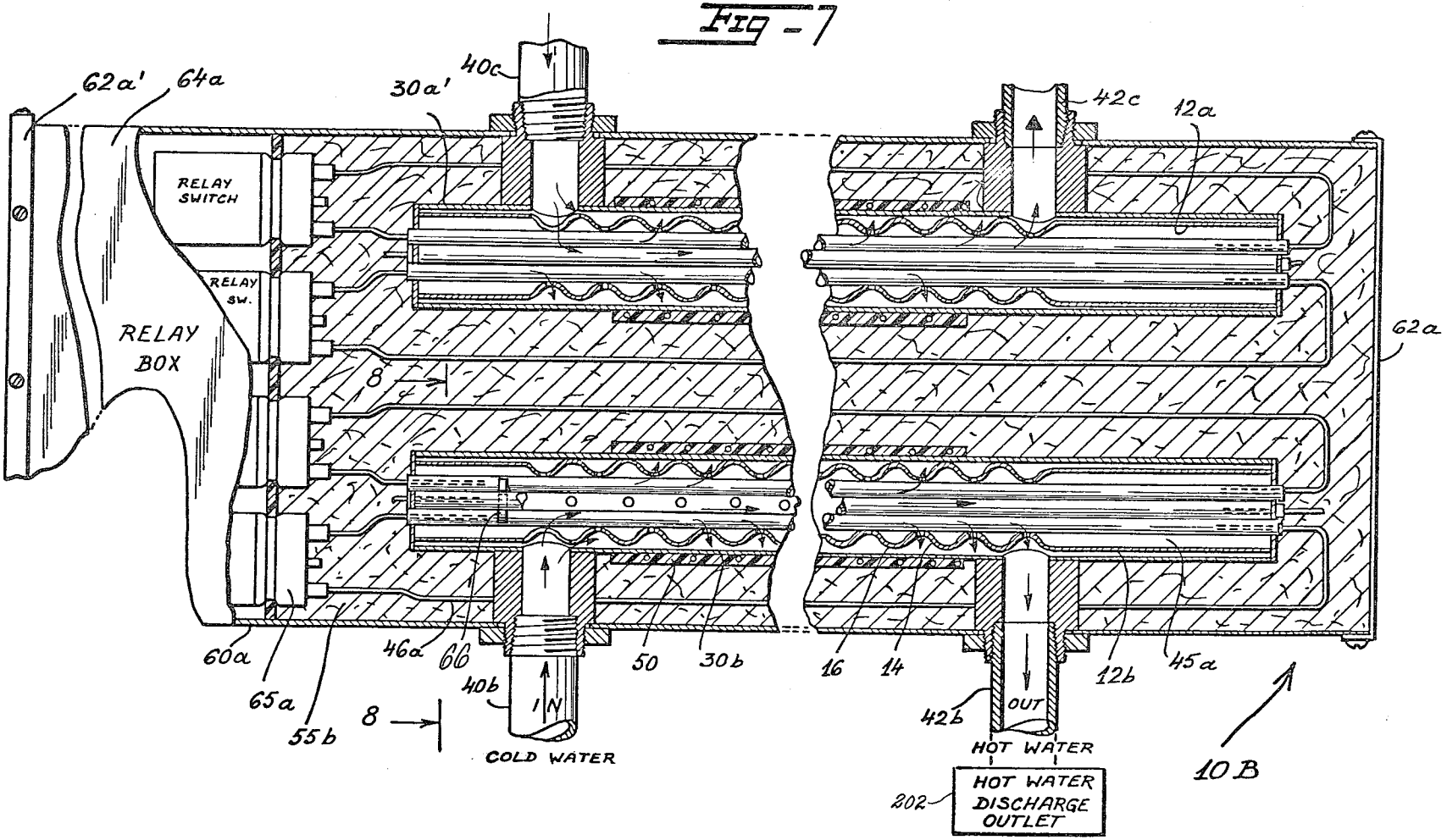
FIG. 7 is a longitudinal section view, partly broken away and partly in section, of a further embodiment of a heat exchanger of the present invention.

In FIG. 7 there is shown a further embodiment 10B of a heat exchanger 10B incorporating the present invention. The heat exchanger 10B is generally similar to the heat exchanger 10A and corresponding parts are identically numbered. However, in heat exchanger 10B there are shown provided two spirally twisted tubes 12*a* and 12*b*. In each tube is a set of four straight electrical heating elements or rods 45*a* held in fixed spaced array by suitable transversely spaced support elements 66 disposed inside the twisted tube. Each tube is surrounded by an electrically heated mat 50. Opposite ends of the resistance heating wires 46*a* terminate at relays switches 65*a* located in relay box 64*a*. The relay switches are adapted to be connected in a thermostatically controlled circuit for operation in the system. Wires 46*a* extend through the thermal insulation 55*b* which surrounds both tubes 12*a* and 12*b*. The insulation 55*b* is enclosed in a snug fitting casing or sheath 60*a* closed at opposite ends by caps 62*a* and 62*a'*. The heat exchanger has two water inlet conduits 40*b* and 40*c*. Inlet 40*b* passes cold water into casing 30*b*. Inlet 40*c* passes recirculating or captured water into casing 30*a'*. The heat exchanger has two outlet conduits 42 *b* and 42*c*. Outlet 42*b* passes hot water out of casing 30*a'*. The hot water which leaves casing 30*b* is delivered to a hot water discharge outlet 202. Since the heat exchanger provides substantially instantaneous heating, a hot water storage tank is not required. Such enables considerable economic savings to be made in the installation and operation of the system.

While I have illustrated and described several preferred embodiments of my invention, it is to be understood that I do not limit myself to the precise construction herein disclosed and that various changes and modifications may be made within the scope of the invention as defined in the appended claims.

I claim:

1. A heat exchanger comprising a plurality of generally coaxial elongated tubes including a first inner tube providing a first inner tube longitudinally extending fluid passageway within the first tube and a second tube surrounding the first tube and defining therewith a second outer longitudinally extending fluid passageway around the first inner tube, first means for conducting fluid to one longitudinal end of each of the fluid passageways for providing flow of the fluid along each fluid passageway in a respective one longitudinal direction therein from its one longitudinal end towards its other longitudinal end respectively, outlet conduit means for conducting fluid from each of the fluid passageways comprising a plurality of longitudinally spaced openings in the first inner tube for conducting fluid from one of the fluid passageways to the other fluid passageway and second means for conducting, from said other longitudinal end of said other fluid passageway, the fluid conducted to said other fluid passageway by said first means and the fluid conducted through said longitudinally spaced openings to said other fluid passageway from said one fluid passageway, third means closing said other longitudinal end of said one fluid passageway, and heater means within said one fluid passageway for heating the fluid in said one fluid passageway whereby the fluid conducted along said one fluid passageway is first heated by the heater means and is then conducted through the longitudinally spaced openings in the first inner tube to combine with the fluid conducted along said other passageway, said first inner tube having at least one generally helical corrugation extending longitudinally therealong and forming a generally helical ridge and groove providing inner and outer generally helical channel portions in the first inner and second outer fluid passageways, and the longitudinally spaced openings being spaced along at least one of the generally helical channel portions.

2. A heat exchanger comprising a plurality of generally coaxial elongated tubes including a first inner tube providing a first inner longitudinally extending fluid passageway within the first tube and a second tube surrounding the first tube and defining therewith a second outer longitudinally extending fluid passageway around the first tube, first means for conducting fluid to one longitudinal end of each of the fluid passageways for providing flow of the fluid along each fluid passageway in a respective one longitudinal direction therein from its one longitudinal end toward its other longitudinal end respectively, outlet conduit means for conducting fluid from each of the fluid passageways comprising a plurality of longitudinally spaced openings in the first inner tube for conducting fluid through said openings from the first inner to the second outer fluid passageway and second means for conducting, from the other longitudinal end of said second outer fluid passageway, the fluid conducted to said second outer fluid passageway by the first means and the fluid conducted through said longitudinally spaced openings to said second outer fluid passageway from said first inner fluid passageway, third means closing said other longitudinal end of said first inner fluid passageway, and heater means within said first inner fluid passageway for heating the fluid in said first inner fluid pasageway whereby the fluid conducted along said first inner fluid passageway is first heated by the heater means and is then conducted through the longitudinally spaced openings in the first inner tube combine with the fluid conducted along said second outer fluid passageway, the first inner tube having generally helical groove means forming a generally helical channel portion in the outer passageway.

3. A heat exchanger according to claim 2 wherein the outer and inner tubes are so disposed relative to each other as to require the fluid to be conducted through the helical channel portion, and wherein the longitudinally spaced openings are spaced along said generally helical groove means.

4. A water heater comprising an elongated generally tubular casing having water inlet and outlet conduits at opposite longitudinal ends thereof for conducting water in one longitudinal direction through the casing, an elongated inner tube disposed generally coaxially within said casing, the inner tube having generally helical ridge and groove means extending along a substantial portion of the length thereof to define a helical channel portion between the tube and cylindrical casing for conducting water in said one longitudinal direction through the casing from the water inlet conduit to the water outlet conduit, said inner tube having water inlet conduit means at one end thereof communicating with the water inlet conduit of the casing for conducting the water entering the casing through its said inlet conduit into the inner tube at its said one longitudinal end thereof for being longitudinally conducted within the inner tube toward the other longitudinal end thereof, means closing said other longitudinal end of said inner tube, and elongated heater means disposed within said inner tube for heating water in the inner tube, said inner tube having a plurality of longitudinally spaced openings for conducting hot water and steam from the inner tube into the helical channel portion to combine with the water conducted through the helical channel.

5. A water heater according to claim 4 wherein the helical ridge and groove means comprises a plurality of parallel generally helical ridges and grooves extending along the inner tube for a substantial portion of the length thereof.

6. A water heater according to claim 4 wherein the elongated heater means comprises a plurality of elongated electrically heated rods disposed in generally parallel laterally spaced relationship within said inner tube.

7. A water heater according to claim 4 further comprising an elongated electrically heated sleeve surrounding said casing.

8. A fluid heat exchanger comprising a plurality of generally coaxial elongated tubes including a first elongated inner tube providing a first inner longitudinally extending fluid passageway and a second elongated outer tube surrounding the first tube and defining therewith a second outer longitudinally extending fluid passageway along the first inner tube, the first inner tube having generally helical groove means defining generally helical fluid channel means extending around the first inner tube and forming a portion of the outer fluid passageway, first means for conducting fluid to one longitudinal end of each of the fluid passageways for conducting fluid along each fluid passageway in a respective one longitudinal direction therein from its respective one longitudinal end toward its other longitudinal end, outlet conduit means for conducting fluid from each of the fluid passageways including a plurality of openings in the inner tube along the helical channel means for conducting fluid from the inner fluid passageway to the helical channel means of the outer fluid passageway and second means for conducting fluid from said other longitudinal end of said outer fluid passageway, third means for closing said other longitudinal end of said inner fluid passageway, and elongated heater means mounted within the inner tube for heating the fluid conducted along said inner passageway whereby the water conducted along the inner passageway is heated by the heater means and then conducted through the openings in the inner tube to combine with the fluid conducted along the channel means.

9. A method of electrically heating water comprising the steps of providing a first inner elongated conduit having helical groove means defining generally helical fluid channel means extending around the first inner conduit and a plurality of longitudinally spaced openings in the first inner conduit along the helical channel means, the first inner elongated conduit defining a first inner elongated fluid passageway, providing a second outer elongated conduit surrounding the first conduit and defining therewith a second outer elongated fluid passageway which includes the generally helical fluid channel means, conducting water into one longitudinal end of, longitudinally through and then out the other longitudinal end of one of the elongated fluid passageways, conducting different water into one longitudinal end of the other fluid passageway for being conducted along the other fluid passageway toward its other end, electrically heating the water in said other fluid passageway and thereby convert at least some of the water therein into steam and conducting said steam and heated water through the longitudinally spaced openings in the inner conduit to combine with and for the steam to be condensed by and thereby heat the water being conducted through said one passageway.

10. A method of electrically heating water comprising the steps of providing first and second elongated generally parallel fluid passageways with a separator therebetween with longitudinally spaced openings therein providing fluid communication between the first and second elongated generally parallel fluid passageways, conducting water into one longitudinal end of, longitudinally through and then out the other longitudinal end of one of the elongated fluid passageways and conducting different water into one longitudinal end of said other fluid passageway for being longitudinally conducted therealong toward the other longitudinal end of said other fluid passageway, electrically heating the water in said other fluid passageway and thereby convert at least some of the water therein into steam and conducting the steam and heated water through the longitudinally spaced openings to combine with and for the steam to be condensed by and thereby heat the water as it is conducted through said one passageway.

* * * * *